US007204108B2

(12) United States Patent
Yu

(10) Patent No.: US 7,204,108 B2
(45) Date of Patent: Apr. 17, 2007

(54) DUAL LOCK HAVING AN IDENTIFICATION FUNCTION

(76) Inventor: Chun Te Yu, No. 253, Sec. 3, Yanhai Rd., Fusing Township, Changhua County 506 (TW)

( * ) Notice: Subject to any disclaimer, the term of this patent is extended or adjusted under 35 U.S.C. 154(b) by 147 days.

(21) Appl. No.: 10/998,619

(22) Filed: Nov. 30, 2004

(65) Prior Publication Data

US 2006/0032274 A1 Feb. 16, 2006

(30) Foreign Application Priority Data

Oct. 8, 2004 (TW) ..... 93216063 U

(51) Int. Cl.
*E05B 37/10* (2006.01)

(52) U.S. Cl. ..... 70/21; 70/25; 70/330; 70/432

(58) Field of Classification Search ..... 70/21, 70/24–25, 27–30, 45–49, 38 R, 38 A–38 C, 70/284–285, 432, 435, 437, 441, DIG. 63, 70/DIG. 71

See application file for complete search history.

(56) References Cited

U.S. PATENT DOCUMENTS

| | | | | |
|---|---|---|---|---|
| 972,171 | A * | 10/1910 | Dupont | 70/21 |
| 3,808,848 | A * | 5/1974 | Yang | 70/21 |
| 3,837,189 | A * | 9/1974 | Atkinson | 70/21 |
| 6,877,345 | B1 * | 4/2005 | Misner et al. | 70/25 |
| 7,007,521 | B1 * | 3/2006 | Misner et al. | 70/21 |
| 7,047,773 | B1 * | 5/2006 | Lin | 70/25 |
| 2002/0088256 | A1 * | 7/2002 | Taylor et al. | 70/25 |
| 2004/0226323 | A1 * | 11/2004 | Ling et al. | 70/25 |
| 2004/0226324 | A1 * | 11/2004 | Loughlin et al. | 70/25 |
| 2005/0034492 | A1 | 2/2005 | Yu | |
| 2005/0039501 | A1 | 2/2005 | Yu | |
| 2005/0092036 | A1 * | 5/2005 | Lai | 70/25 |
| 2005/0262902 | A1 * | 12/2005 | Ling et al. | 70/21 |
| 2005/0262903 | A1 * | 12/2005 | Ling et al. | 70/21 |

* cited by examiner

*Primary Examiner*—Suzanne Dino Barrett
*Assistant Examiner*—Christopher Boswell
(74) *Attorney, Agent, or Firm*—Rosenberg, Klein & Lee

(57) ABSTRACT

A dual lock includes a housing, a shackle, a first locking mechanism, an identification member, a second locking mechanism, and an urging member. Thus, the identification zones of the identification member are exposed from the windows of the housing if the dual lock has been unlocked for checking the luggage so as to remind a user to inspect if contents of the luggage that has been checked are missed or lost.

16 Claims, 5 Drawing Sheets

DUAL LOCK HAVING AN IDENTIFICATION FUNCTION

BACKGROUND OF THE INVENTION

1. Field of the Invention

The present invention relates to a dual lock, and more particularly to a dual lock an identification function.

2. Description of the Related Art

A conventional dual lock in accordance with the prior art is disclosed in the Taiwanese Patent Publication No. 590146 and comprises a housing, a shackle mounted on the housing, a first locking mechanism mounted on the housing to lock and unlock the shackle, and a second locking mechanism mounted on the housing to lock and unlock the shackle. The first locking mechanism can be opened the user only, and the second locking mechanism can be opened a specified key. The specified key is held by an inspector of the customs, so that the inspector can directly unlock the second locking mechanism of the dual lock by the specified key so as to open and check a luggage locked by the dual lock without having to break the dual lock for checking the luggage. Then, the inspector can directly lock the second locking mechanism of the dual lock by the specified key so as to lock the luggage by the dual lock again. However, the user cannot directly judge if the dual lock has been unlocked by the inspector for checking the luggage, so that the user has to unlock multiple dual locks to inspect each luggage so as to judge if the luggage has been checked, thereby causing inconvenience to the user.

SUMMARY OF THE INVENTION

The primary objective of the present invention is to provide a dual lock an identification function.

Another objective of the present invention is to provide a dual lock, wherein the identification zones of the identification member are exposed from the windows of the housing if the dual lock has been unlocked for checking the luggage so as to remind a user to inspect if contents of the luggage that has been checked are missed or lost.

A further objective of the present invention is to provide a dual lock, wherein the user can directly and easily judge if the dual lock has been unlocked for checking the luggage, so that the user can inspect the luggage that has been checked without having to inspect the luggage that has never been checked.

In accordance with the present invention, there is provided a dual lock, comprising:

a housing having at least one window;

a shackle mounted on the housing and having a first end formed with a pivot shaft pivotally mounted in and axially movable relative to the housing and a second end formed with a locking portion moved with the pivot shaft;

a first locking mechanism mounted in the housing to lock and unlock the pivot shaft of the shackle;

an identification member slidably mounted in the housing and having at least one identification zone that is movable to align with the window of the housing;

a second locking mechanism rotatably mounted in the housing and rotatable between a locking position where the locking portion of the shackle is locked by the second locking mechanism and an unlocking position where the locking portion of the shackle is released from the second locking mechanism and the identification member is moved by the second locking mechanism to align the identification zone of the identification member with the window of the housing.

Further benefits and advantages of the present invention will become apparent after a careful reading of the detailed description with appropriate reference to the accompanying drawings.

DETAILED DESCRIPTION OF THE INVENTION

Figure 1:
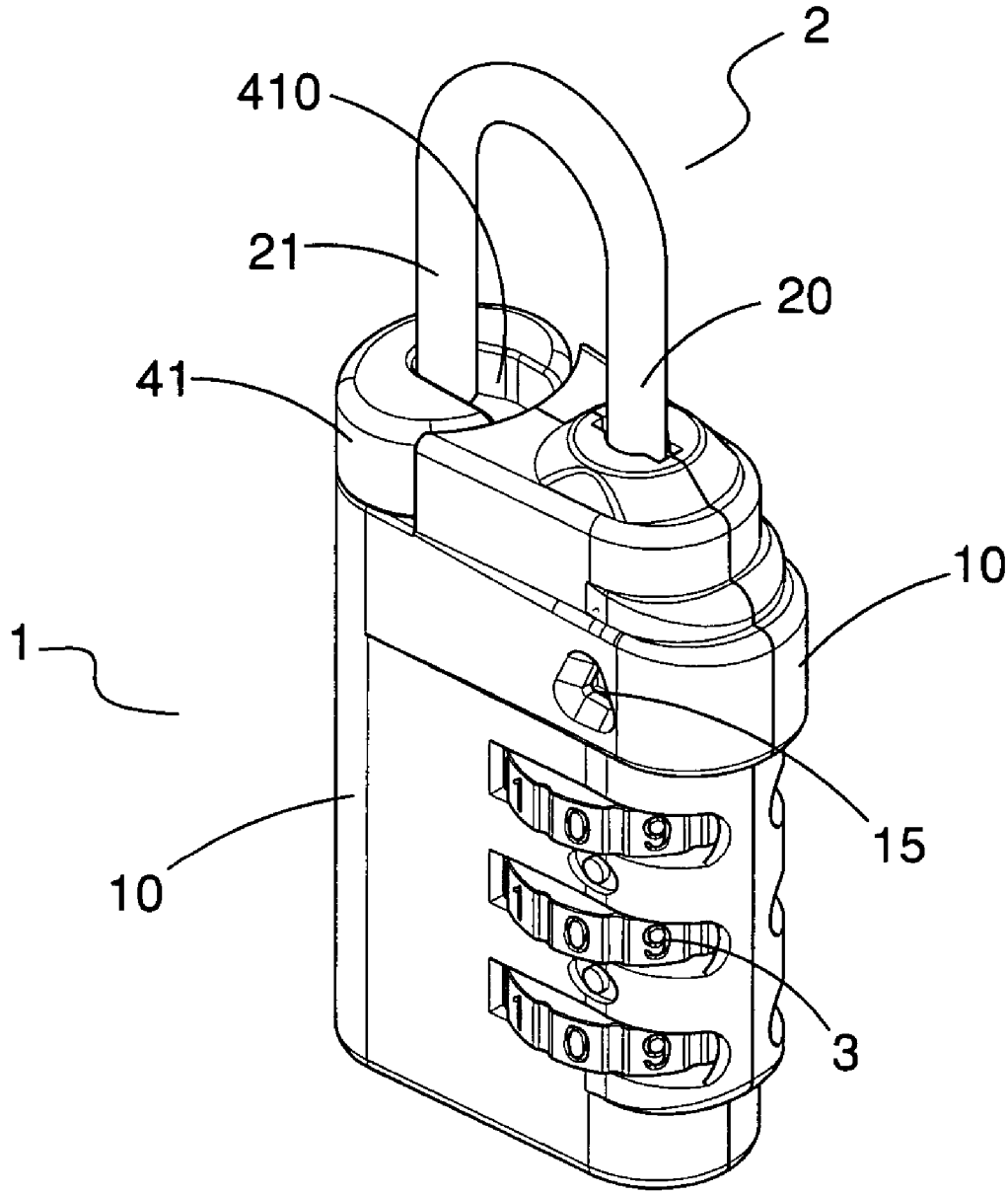
FIG. 1 is a perspective view of a dual lock in accordance with the preferred embodiment of the present invention.
Figure 2:
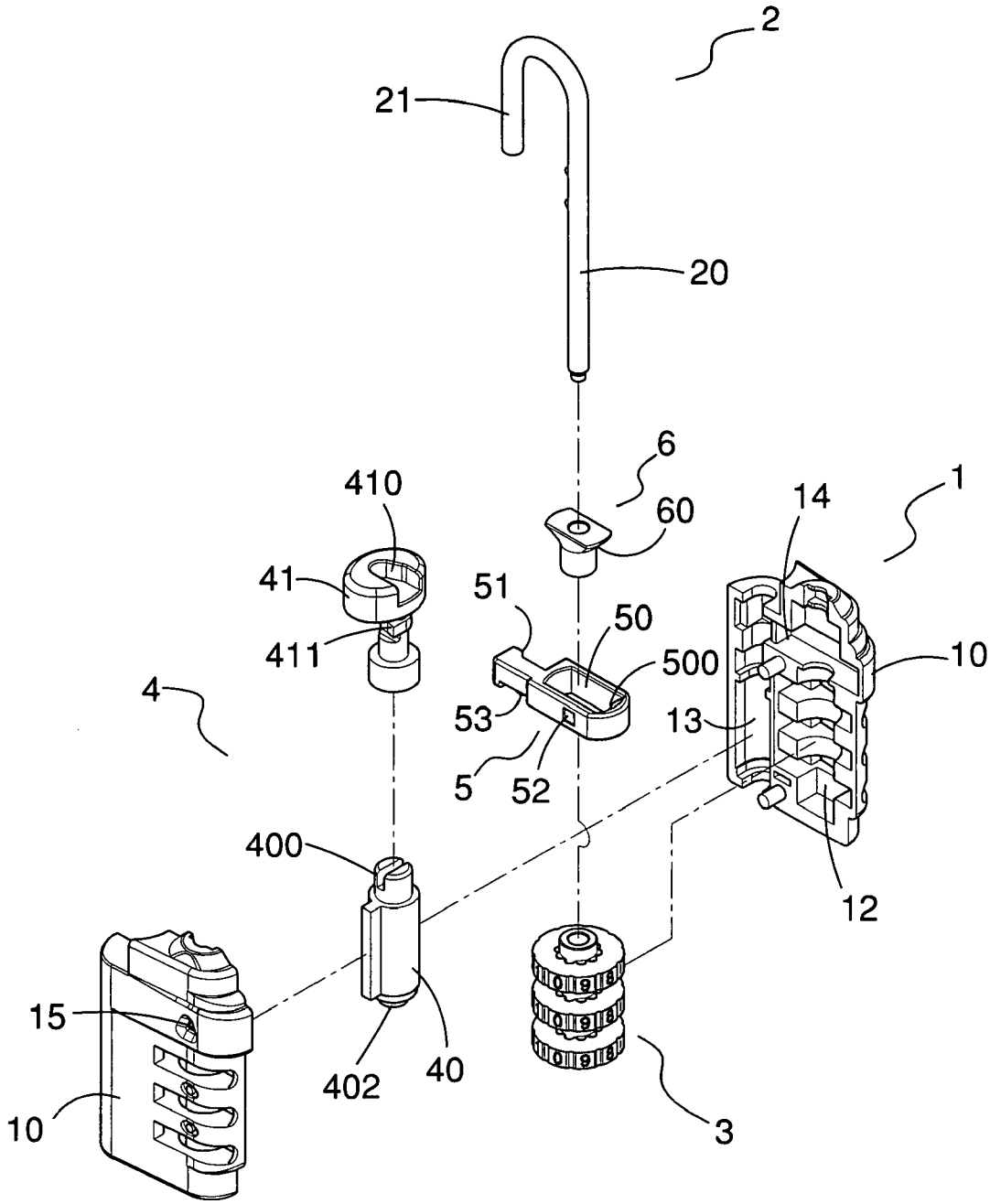
FIG. 2 is an exploded perspective view of the dual lock as shown in FIG. 1.
Figure 3:
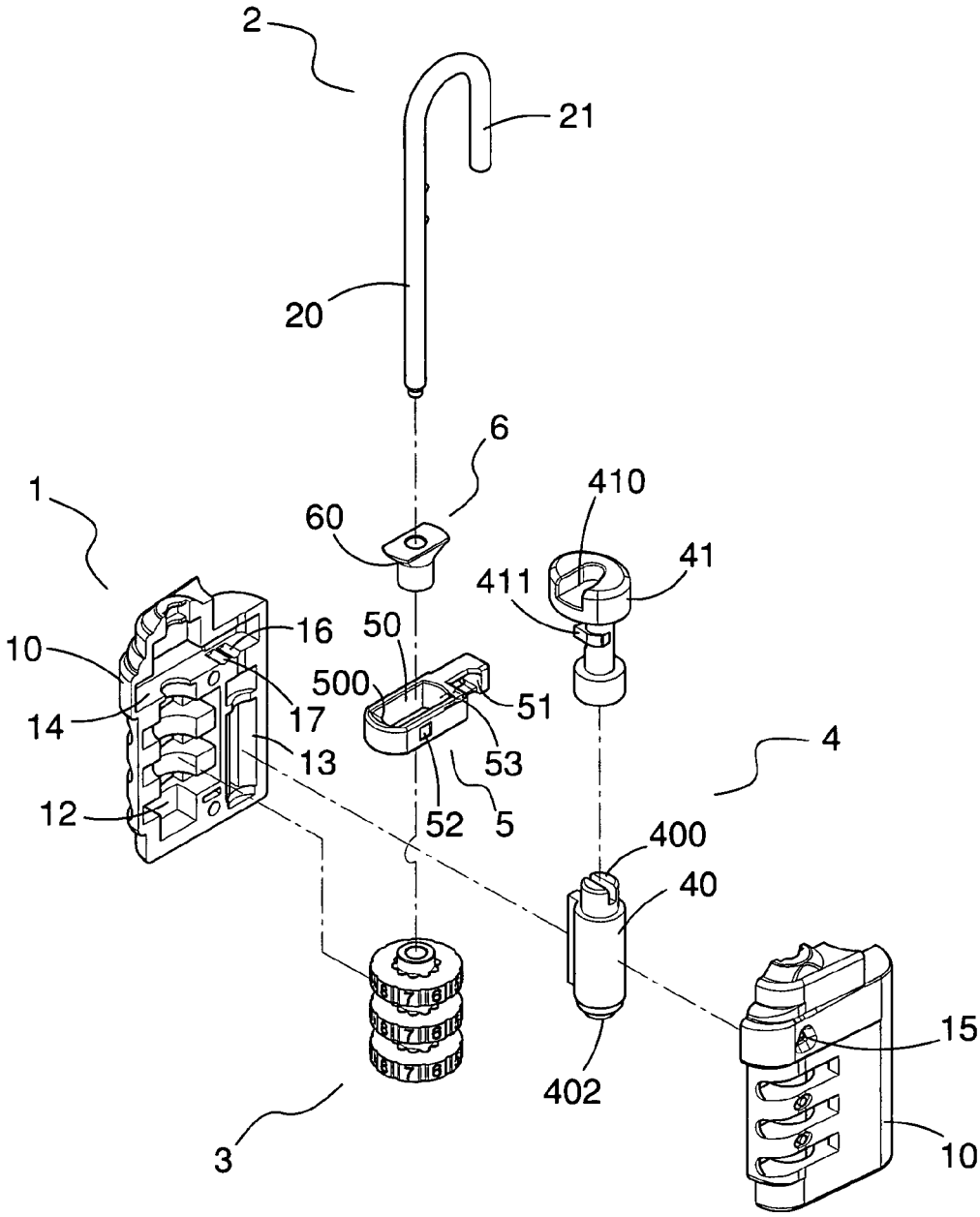
FIG. 3 is an exploded perspective view of the dual lock as shown in FIG. 1.

Referring to the drawings and initially to FIGS. 1–6, a dual lock in accordance with the preferred embodiment of the present invention comprises a housing 1 having at least one window 15, a shackle 2 mounted on the housing 1 and having a first end formed with a pivot shaft 20 pivotally mounted in and axially movable relative to the housing 1 and a second end formed with a locking portion 21 moved with the pivot shaft 20, a first locking mechanism 3 mounted in the housing 1 to lock and unlock the pivot shaft 20 of the shackle 2, an identification member 5 slidably mounted in the housing 1 and having at least one identification zone 52 that is movable to align with the window 15 of the housing 1, and a second locking mechanism 4 rotatably mounted in the housing 1 and rotatable between a locking position where the locking portion 21 of the shackle 2 is locked by the second locking mechanism 4 and an unlocking position where the locking portion 21 of the shackle 2 is released from the second locking mechanism 4 and the identification member 5 is moved by the second locking mechanism 4 to align the identification zone 52 of the identification member 5 with the window 15 of the housing 1.

The housing 1 includes two casings 10 combined with each other. The housing 1 has an inside formed with a first receiving recess 12 to receive the first locking mechanism 3, a second receiving recess 13 to receive the second locking mechanism 4, and a third receiving recess 14 to receive the identification member 5. The housing 1 has two opposite windows 15 each communicating with the third receiving recess 14, and the identification member 5 has two opposite identification zones 52.

The shackle 2 is substantially U-shaped. The locking portion 21 of the shackle 2 is rotatable relative to the housing 1 between a closed position where the locking portion 21 of the shackle 2 is locked on the housing 1 and an opened position where the locking portion 21 of the shackle 2 is released from the housing 1.

The first locking mechanism 3 is switched between a locking position where the pivot shaft 20 of the shackle 2 is locked by the first locking mechanism 3 and cannot be axially movable relative to the housing 1 and an unlocking position where the pivot shaft 20 of the shackle 2 is unlocked from the first locking mechanism 3 and is axially movable relative to the housing 1.

Preferably, the first locking mechanism 3 is number lock, and the pivot shaft 20 of the shackle 2 is extended through the first locking mechanism 3, so that when the numbers of the first locking mechanism 3 are correct, the pivot shaft 20 of the shackle 2 is unlocked from the first locking mechanism 3 and is axially movable relative to the housing 1, and when one of the numbers of the first locking mechanism 3 is not correct, the pivot shaft 20 of the shackle 2 is locked by the first locking mechanism 3 and cannot be axially movable relative to the housing 1.

The second locking mechanism 4 is rotated by a specified key (not shown). The second locking mechanism 4 includes a lock core 40 rotatably mounted in the housing 1 and having a first end formed with a drive shaft 400 and a second end 402 that is driven and rotated by the specified key, and a locking member 41 having a first end secured on the drive shaft 400 of the lock core 40 to rotate therewith and a second end protruding outward from the housing 1 and rotatable between the locking position of the second locking mechanism 4 where the locking portion 21 of the shackle 2 is locked by the locking member 41 of the second locking mechanism 4 and the unlocking position of the second locking mechanism 4 where the locking portion 21 of the shackle 2 is released from the locking member 41 of the second locking mechanism 4. The second end of the locking member 41 of the second locking mechanism 4 has an end face formed with a locking recess 410 having an end extended through a peripheral wall of the locking member 41 to lock and unlock the locking portion 21 of the shackle 2. Preferably, the lock core 40 and the locking member 41 of the second locking mechanism 4 are separated from each other. Alternatively, the lock core 40 and the locking member 41 of the second locking mechanism 4 are formed integrally.

Thus, when the locking member 41 of the second locking mechanism 4 is rotated to the locking position of the second locking mechanism 4, the locking recess 410 of the locking member 41 is blocked by the housing 1 as shown in FIG. 1, so that the locking portion 21 of the shackle 2 is locked by the locking member 41 of the second locking mechanism 4, and when the locking member 41 of the second locking mechanism 4 is rotated to the unlocking position of the second locking mechanism 4, the locking recess 410 of the locking member 41 is separated from the housing 1 and having an opening facing outward, so that the locking portion 21 of the shackle 2 is released from the locking member 41 of the second locking mechanism 4.

The identification member 5 is linearly movable in the housing 1 between a first position where the identification zone 52 of the identification member 5 is aligned with the window 15 of the housing 1 and a second position where the identification zone 52 of the identification member 5 is separated from the window 15 of the housing 1.

The identification member 5 has an end formed with a protruding resting face 51, and the locking member 41 of the second locking mechanism 4 has a mediate portion formed with a recessed push block 411 extended into the third receiving recess 14 of the housing 1 and rested on the resting face 51 of the identification member 5, so that when the locking member 41 of the second locking mechanism 4 is rotated, the push block 411 pushes the resting face 51 of the identification member 5 to move the identification member 5 to align the identification zone 52 of the identification member 5 with the window 15 of the housing 1.

One of the two casings 10 of the housing 1 has an inside formed with a first positioning groove 16 and a second positioning groove 17 each located in the third receiving recess 14, and the identification member 5 has a side formed with an elastic positioning boss 53 that is positioned in the first positioning groove 16 of the housing 1 when the identification zone 52 of the identification member 5 is aligned with the window 15 of the housing 1 and is positioned in the second positioning groove 17 of the housing 1 when the identification zone 52 of the identification member 5 is separated from the window 15 of the housing 1.

The dual lock further comprises an urging member 6 secured on the pivot shaft 20 of the shackle 2 to move with the pivot shaft 20 of the shackle 2 axially in the housing 1 and urged on the identification member 5 to move the identification member 5 in the housing 1 to its second position so that the identification zone 52 of the identification member 5 is separated from the window 15 of the housing 1.

Preferably, the identification member 5 has an inside formed with a tapered guide face 500, and the urging member 6 is axially movable in the inside of the identification member 5 and has a side formed with a tapered push face 60 urged on the tapered guide face 500 of the identification member 5. Thus, when the pivot shaft 20 of the shackle 2 is moved axially in the housing 1, the tapered push face 60 of the urging member 6 is urged on the tapered guide face 500 of the identification member 5 so as to move the identification member 5 in the housing 1 to its second position so that the identification zone 2 of the identification member 5 is separated from the window 15 of the housing 1.

The inside of the identification member 5 is formed with an elongated slot 50 having a side formed with the tapered guide face 500, and the urging member 6 is movable in the elongated slot 50 of the identification member 5. In addition, the pivot shaft 20 of the shackle 2 is extended through the urging member 6 and the first locking mechanism 3.

In operation, when the locking member 41 of the second locking mechanism 4 is rotated to the locking position of the second locking mechanism 4, the locking recess 410 of the locking member 41 is blocked by the housing 1 as shown in FIG. 1, so that the locking portion 21 of the shackle 2 is locked by the locking member 41 of the second locking mechanism 4.

When the locking member 41 of the second locking mechanism 4 is rotated by the specified key (the key is held by an inspector of the customs) to the unlocking position of the second locking mechanism 4, the locking recess 410 of the locking member 41 is separated from the housing 1, so that the locking portion 21 of the shackle 2 is released from the locking member 41 of the second locking mechanism 4 and is rotated about the pivot shaft 20 to move outward so as to unlock the dual lock from an article, such as a luggage, thereby facilitating the inspector of the customs inspecting the luggage.

Figure 5:
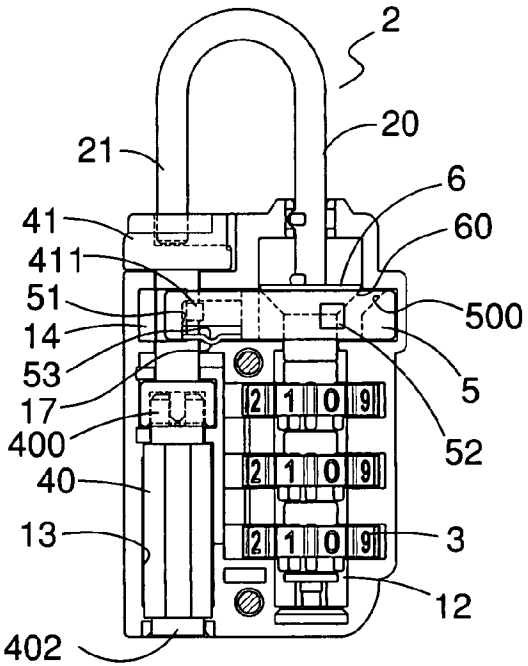
FIG. 5 is a plan cross-sectional view of the dual lock as shown in FIG. 1.
Figure 6:
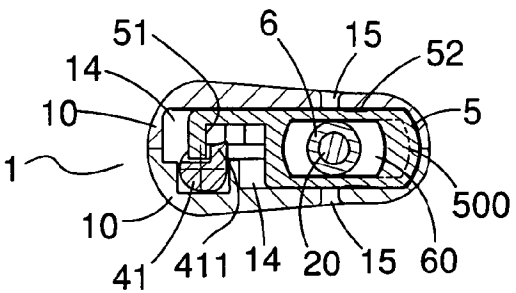
FIG. 6 is a plan cross-sectional view of the dual lock as shown in FIG. 5.
Figure 4:
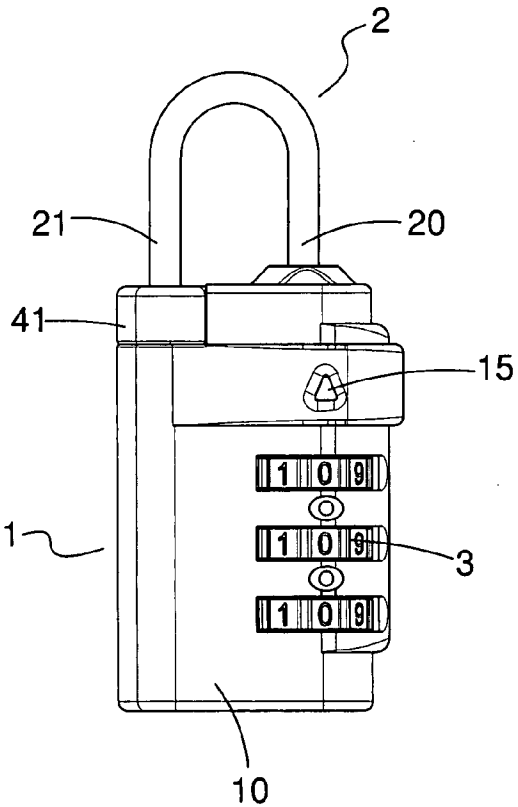
FIG. 4 is a plan view of the dual lock as shown in FIG. 1.
Figure 7:
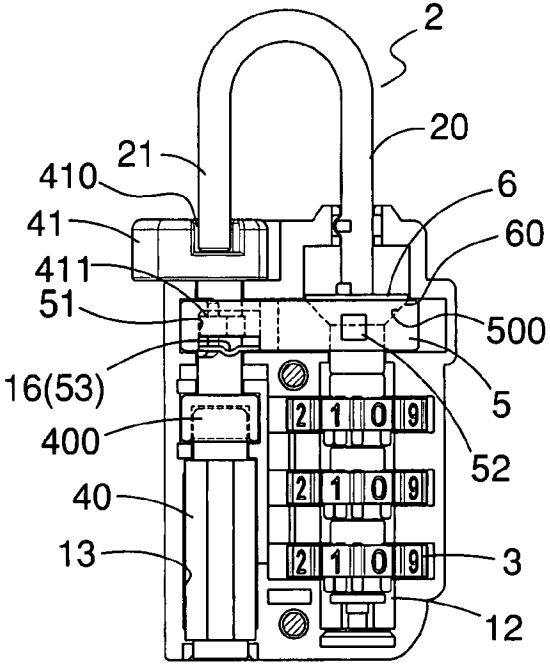
FIG. 7 is a schematic operational view of the dual lock as shown in FIG. 5.
Figure 8:
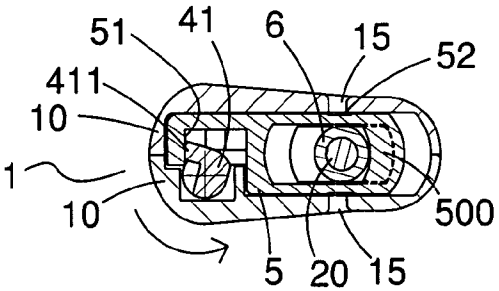
FIG. 8 is a schematic operational view of the dual lock as shown in FIG. 6.

At the same time, when the locking member 41 of the second locking mechanism 4 is rotated, the push block 411 of the locking member 41 pushes the resting face 51 of the identification member 5 to move the identification member 5 from the position as shown in FIGS. 5 and 6 the position as shown in FIGS. 7 and 8 to align the identification zones 52 of the identification member 5 with the windows 15 of the housing 1.

After inspection of the luggage, the locking portion 21 of the shackle 2 is rotated about the pivot shaft 20 to move to the original position and the locking member 41 of the second locking mechanism 4 is rotated by the specified key to the locking position of the second locking mechanism 4 as shown in FIG. 1 so as to lock the luggage by the dual lock again.

At this time, the push block 411 of the locking member 41 is moved to the original position as shown in FIG. 6 while the identification member 5 is still located at the position as shown in FIG. 8, so that the identification zones 52 of the identification member 5 are still exposed from the windows 15 of the housing 1.

In such a manner, the identification zones 52 of the identification member 5 are exposed from the windows 15 of the housing 1 if the dual lock has been unlocked for checking the luggage. Alternatively, the identification zones 52 of the identification member 5 are not exposed from the windows 15 of the housing 1 if the dual lock has never been unlocked for checking the luggage. Thus, a user can directly and easily judge if the dual lock has been unlocked for checking the luggage, so that the user can inspect the luggage that has been checked without having to inspect the luggage that has never been checked.

Figure 9:
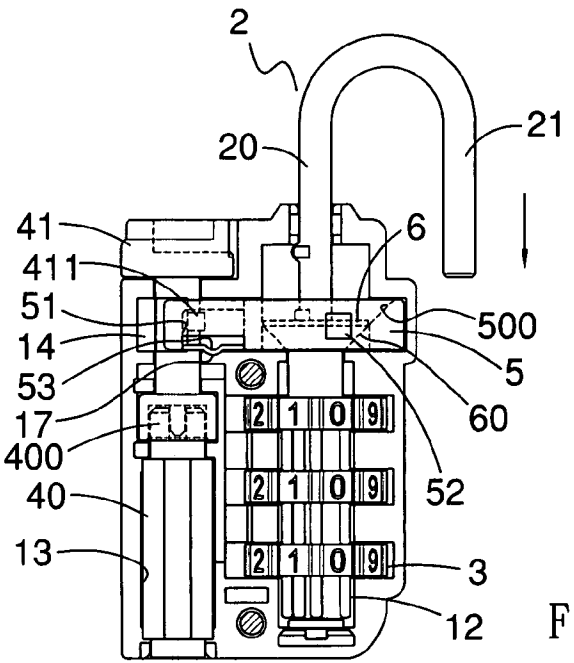
FIG. 9 is a schematic operational view of the dual lock as shown in FIG. 7.
Figure 10:
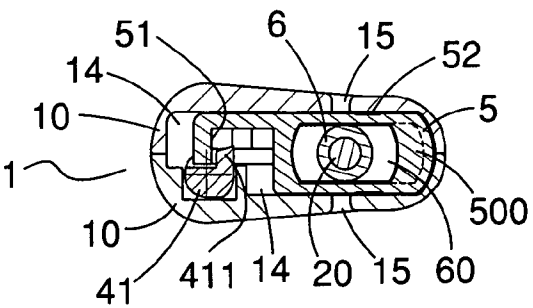
FIG. 10 is a schematic operational view of the dual lock as shown in FIG. 8.

As shown in FIGS. 9 and 10, when the numbers of the first locking mechanism 3 are correct, the pivot shaft 20 of the shackle 2 is unlocked from the first locking mechanism 3 and is axially movable relative to the housing 1. When the pivot shaft 20 of the shackle 2 is pressed to move downward relative to the housing 1, the tapered push face 60 of the urging member 6 is urged on the tapered guide face 500 of the identification member 5 so as to move the identification member 5 in the housing 1 to return to its original position as shown in FIG. 10, so that the identification zone 52 of the identification member 5 is separated from the window 15 of the housing 1.

Accordingly, the identification zones 52 of the identification member 5 are exposed from the windows 15 of the housing 1 if the dual lock has been unlocked for checking the luggage so as to remind a user to inspect if contents of the luggage that has been checked are missed or lost. In addition, the user can directly and easily judge if the dual lock has been unlocked for checking the luggage, so that the user can inspect the luggage that has been checked without having to inspect the luggage that has never been checked.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A dual lock comprising:

a housing having at least one window;

a shackle mounted on the housing and having a first end formed with a pivot pivotally disposed in the housing and a second end formed with a locking portion moved with the pivot;

a first locking mechanism disposed in the housing to lock and unlock the pivot of the shackle;

an identification member being slidably disposed in the housing and having at least one identification zone that is movable to align with the window of the housing; and a second locking mechanism being rotatably disposed in the housing between a locking position where the locking portion of the shackle is locked by the second locking mechanism and an unlocking position where the locking portion of the shackle is released from the second locking mechanism and the identification member is moved by the second locking mechanism to align the identification zone of the identification member with the window of the housing; and comprising:

a lock core being rotatably mounted in the housing and including a shaft formed at an end; and a locking member including a first end secured to the shaft of the lock core to rotate therewith; and a second end protruding from the housing and being rotatable between the locking position and the unlocking position and comprising a locking recess defined therein, wherein the locking recess comprises an end extended through a peripheral wall of the locking member to lock and unlock the locking portion of the shackle.

2. The dual lock in accordance with claim 1, wherein the locking portion of the shackle is rotatable relative to the housing between a closed position where the locking portion of the shackle is locked on the housing and an opened position where the locking portion of the shackle is released from the housing.

3. The dual lock in accordance with claim 1, wherein the first locking mechanism is switched between a locking position where the pivot of the shackle is locked by the first locking mechanism and cannot be axially movable relative to the housing and an unlocking position where the pivot of the shackle is unlocked from the first locking mechanism and is axially movable relative to the housing.

4. The dual lock in accordance with claim 1, wherein the first locking mechanism is number lock, and the pivot of the shackle is extended through the first locking mechanism, so that when numbers of the first locking mechanism are correct, the pivot of the shackle is unlocked from the first locking mechanism and is axially movable relative to the housing, and when one of the numbers of the first locking mechanism is not correct, the pivot of the shackle is locked by the first locking mechanism and cannot be axially movable relative to the housing.

5. The dual lock in accordance with claim 1, wherein when the locking member of the second locking mechanism is rotated to the locking position of the second locking mechanism, the locking recess of the locking member is blocked by the housing, so that the locking portion of the shackle is locked by the locking member of the second locking mechanism, and when the locking member of the second locking mechanism is rotated to the unlocking position of the second locking mechanism, the locking recess of the locking member is separated from the housing and having an opening facing outward, so that the locking portion of the shackle is released from the locking member of the second locking mechanism.

6. The dual lock in accordance with claim 1, wherein the lock core and the locking member of the second locking mechanism are separated from each other.

7. The dual lock in accordance with claim 1, wherein the lock core and the locking member of the second locking mechanism are formed integrally.

8. The dual lock in accordance with claim 1, wherein the identification member is linearly movable in the housing between a first position where the identification zone of the identification member is aligned with the window of the housing and a second position where the identification zone of the identification member is separated from the window of the housing.

9. The dual lock in accordance with claim 1, wherein the identification member has an end formed with a protruding resting face, and the locking member of the second locking mechanism has a mediate portion formed with a push block rested on the resting face of the identification member, so that when the locking member of the second locking mechanism is rotated, the push block pushes the resting face of the identification member to move the identification member to align the identification zone of the identification member with the window of the housing.

10. The dual lock in accordance with claim 1, wherein the identification member has an end formed with a protruding resting face, and the second locking mechanism has a push block rested on the resting face of the identification member, so that when the second locking mechanism is rotated, the push block pushes the resting face of the identification member to move the identification member to align the identification zone of the identification member with the window of the housing.

11. The dual lock in accordance with claim 1, wherein the housing has an inside formed with a first positioning groove and a second positioning groove, and the identification member has a side formed with an elastic positioning boss that is positioned in the first positioning groove of the housing when the identification zone of the identification member is aligned with the window of the housing and is positioned in the second positioning groove of the housing when the identification zone of the identification member is separated from the window of the housing.

12. The dual lock in accordance with claim 1, further comprising an urging member secured on the pivot of the shackle to move with the pivot of the shackle axially in the housing and urged on the identification member to move the identification member in the housing to its second position so that the identification zone of the identification member is separated from the window of the housing.

13. The dual lock in accordance with claim 12, wherein the identification member has an inside formed with a tapered guide face, and the urging member is axially movable in the inside of the identification member and the urging member has a side formed with a tapered push face urged on the tapered guide face of the identification member.

14. The dual lock in accordance with claim 13, wherein the inside of the identification member is formed with an elongated slot having a side formed with the tapered guide face, and the urging member is movable in the elongated slot of the identification member.

15. The dual lock in accordance with claim 12, wherein the pivot of the shackle is extended through the urging member and the first locking mechanism.

16. The dual lock in accordance with claim 1, wherein the housing has two opposite windows, and the identification member has two opposite identification zones.

* * * * *